US007116292B2

(12) United States Patent
Ozawa

(10) Patent No.: US 7,116,292 B2
(45) Date of Patent: Oct. 3, 2006

(54) ELECTRO-OPTICAL PANEL, DRIVING CIRCUIT AND DRIVING METHOD FOR DRIVING ELECTRO-OPTICAL PANEL, AND ELECTRONIC APPARATUS

(75) Inventor: Tokuro Ozawa, Suwa (JP)

(73) Assignee: Seiko, Epson Corporation, Tokyo (JP)

( * ) Notice: Subject to any disclaimer, the term of this patent is extended or adjusted under 35 U.S.C. 154(b) by 266 days.

(21) Appl. No.: 10/779,728

(22) Filed: Feb. 18, 2004

(65) Prior Publication Data

US 2004/0201555 A1 Oct. 14, 2004

(30) Foreign Application Priority Data

Feb. 21, 2003 (JP) ..... 2003-044369

(51) Int. Cl.
*G09G 3/30* (2006.01)
*G09G 3/32* (2006.01)

(52) U.S. Cl. ..... 345/76; 345/82; 345/83

(58) Field of Classification Search ..... 345/76, 345/82–83

See application file for complete search history.

(56) References Cited

U.S. PATENT DOCUMENTS 6,476,897 B1 * 11/2002 Watanabe et al. ..... 349/139
6,613,610 B1 * 9/2003 Iwafuchi et al. ..... 438/128
6,891,520 B1 * 5/2005 Chen et al. ..... 345/82
6,911,961 B1 * 6/2005 Miller et al. ..... 345/82
6,947,019 B1 * 9/2005 Sato et al. ..... 345/82
2002/0030647 A1 * 3/2002 Hack et al. ..... 345/82
2002/0096994 A1 * 7/2002 Iwafuchi et al. ..... 313/495
2002/0196389 A1 * 12/2002 Koyama ..... 349/69
2003/0100150 A1 * 5/2003 Kitakado et al. ..... 438/151
2003/0122749 A1 * 7/2003 Booth et al. ..... 345/82
2003/0146712 A1 * 8/2003 Inukai ..... 315/169.3
2003/0197665 A1 * 10/2003 Sung ..... 345/82

FOREIGN PATENT DOCUMENTS

JP A 2002-175040 6/2002
JP A 2002-207453 7/2002
JP A 2002-278498 9/2002
JP A 2003-108099 4/2003

* cited by examiner

*Primary Examiner*—Kee M. Tung
*Assistant Examiner*—J. Amini
(74) *Attorney, Agent, or Firm*—Oliff & Berridge, PLC

(57) ABSTRACT

The invention provides an electro-optical panel that stores data in pixels with a simple structure. In particular, pixels can be provided in association with intersections of data lines and scanning lines. Each of the pixels includes a hold capacitor, an inverter, an OLED element, and first to third transistors. At a reading period, data stored in the hold capacitor is inverted by the inverter and rewritten to the hold capacitor an even number of times. Thus, the logical level of the hold capacitor can be maintained. At a holding period, the second transistor is turned on. Also, the potential of a high potential source at the reading period is set to be higher than that at the holding period, and the potential of a low potential source at the reading period is set to be lower than that at the holding period.

14 Claims, 16 Drawing Sheets

ELECTRO-OPTICAL PANEL, DRIVING CIRCUIT AND DRIVING METHOD FOR DRIVING ELECTRO-OPTICAL PANEL, AND ELECTRONIC APPARATUS

BACKGROUND OF THE INVENTION

1. Field of Invention

The present invention relates to an electro-optical panel that stores data in pixels provided in association with intersections of a plurality of data lines and a plurality of scanning lines, a driving circuit and a driving method for driving the electro-optical panel, and an electronic apparatus using the electro-optical panel and the driving circuit.

2. Description of Related Art

Active matrix liquid crystal panels are one type of liquid crystal panels using liquid crystal as electro-optical materials. Liquid crystal panels of this type include a plurality of scanning lines and a plurality of data lines, and also include pixels arranged in association with intersections of the data lines and the scanning lines in a matrix.

Furthermore, a technology, for example, as disclosed in Japanese Unexamined Patent Application Publication No. 2002-207453 (e.g., FIGS. 22 and 24), for providing static random access memories (SRAMs) in pixels in order to reduce power consumption is also publicly known.

FIG. 17 shows the structure of a pixel. The pixel can include a liquid crystal capacitor LC, transistors Tr1 to Tr3, and an inverter composed of transistors Tr4 and Tr5. With this circuit structure, an electric charge corresponding to 1-bit image data is stored in the liquid crystal capacitor LC. Then, the electric charge stored in the liquid crystal capacitor LC is rewritten at predetermined intervals. More specifically, the electric charge is rewritten by setting the transistor Tr1 to the off state and by changing the states of the-transistors Tr2 and Tr3 as follows: Tr2=off and Tr3=off→Tr2=off and Tr3 on→Tr2=off and Tr3=off.

At a period for holding the electric charge in the liquid crystal capacitor LC, the transistor Tr2 is set to the on state and the transistor Tr3 is set to the off state.

With this pixel structure, the polarity of a voltage applied to the liquid crystal can be inverted when the electric charge is rewritten, and the image data can be rewritten without using a data line 3. Thus, power consumption of the liquid crystal panel can be reduced.

SUMMARY OF THE INVENTION

However, the technology in which liquid crystal is used as an electro-optical element cannot be straightforwardly applied to electro-optical panels using an organic light-emitting diode element (OLED element). This is because that organic light-emitting diodes do not have a function to hold an electric charge.

The transmittance of liquid crystal is determined in accordance with the effective value of a voltage applied to the liquid crystal, irrespective of the polarity of the applied voltage. Thus, supplying the output of the inverter to the electro-optical element only inverts the polarity of the voltage applied to the liquid crystal, without affecting the transmittance. Or rather, burn-in and the like can be avoided by AC driving. In contrast, OLED elements are turned on and turned off in accordance with the polarity of the applied voltage. Thus, an operation of only supplying the output of the inverter to the OLED element causes turning on and turning off to be the other way around, and a desired image cannot be displayed. In order to solve this problem, a latch circuit provided with two inverters may be arranged in a pixel. However, this structure causes a problem in that, in accordance with an increase in the number of elements, the aperture ratio is reduced and yield is also reduced.

The present invention is designed with respect to the above-mentioned circumstances, and an object of the present invention is to provide an electro-optical panel capable of increasing the aperture ratio and yield, a driving circuit for driving the electro-optical panel, and the like.

In order to achieve the above object, an electro-optical panel according to the present invention can include a plurality of data lines, a plurality of scanning lines, and pixels provided in association with intersections of the data lines and the scanning lines. The pixels can each include a hold capacitor for holding an electric, charge, an inverting device for outputting an output signal obtained by inverting an input signal, a first switching element provided between the corresponding one of the data lines and the hold capacitor, a second switching element provided between the hold capacitor and an input of the inverting device, a third switching element provided between the hold capacitor and an output of the inverting device, and an organic light-emitting diode element connected to the output of the inverting device.

According to the present invention, data can be stored by using the inverting device provided in each of the pixels. Furthermore, an electric charge can be rewritten to the hold capacitor and turning on and turning off of the organic light-emitting diode can be controlled by a driving method described below.

An electro-optical panel according to the present invention can include a plurality of data lines, a plurality of scanning lines, and pixels provided in association with intersections of the data lines and the scanning lines. The pixels each includes an organic light-emitting diode, a hold capacitor for holding an electric charge, an inverting device for outputting an output signal obtained by inverting an input signal, a first switching element provided between the corresponding one of the data lines and the hold capacitor, a second switching element provided between the hold capacitor and an input of the inverting device, a third switching element provided between the hold capacitor and an output of the inverting device, and a fourth switching element provided between the output of the inverting device and the organic light-emitting diode.

According to the present invention, the fourth switching element provided between the output of the inverting device and the oganic light-emitting diode controls the connection state between the output of the inverting device and the organic light-emitting diode. In order to rewrite an electric charge stored in the hold capacitor without changing its logical level, rewriting must be performed an even number of times. By performing writing an odd number of times, the logical level is inverted. Although the output logical level of the inverting device is inverted when the hold capacitor is connected to the input of the inverting device in such a state, the organic light-emitting diode can be disconnected from the output of the inverting device by turning off the fourth switching element. As a result of this, turning on and tuning off of the organic light-emitting diode is not inverted due to rewriting, thus improving the contrast.

A driving circuit according to the present invention for driving an electro-optical panel including a plurality of data lines, a plurality of scanning lines, and pixels provided in association with intersections of the data lines and the scanning lines. The pixels can each include an organic light-emitting diode, an electric charge holding device for holding an electric charge, an inverting device for outputting an output signal obtained by inverting an input signal, a switching device for switching a connection state of the electric charge holding device and the inverting device, output of the inverting device being supplied to the organic light-emitting diode, includes control device for controlling the switching device such that the electric charge holding device is connected to an input of the inverting device and that the electric charge holding device is not connected to an output of the inverting device at a holding period and for controlling the switching device such that the electric charge holding device is connected to the output of the inverting device an even number of times at a reading period.

According to the present invention, the electric charge holding device is connected to the output of the inverting device an even number of times at the reading period. Thus, an electric charge whose logical level is equal to its original logical level is stored in the electric charge holding device. Accordingly, data can be rewritten in a pixel by using a single inverting device, thus significantly improving the aperture ratio and yield of the electro-optical panel.

Preferably, the electro-optical panel further can include first switching elements each provided between each of the data lines and the electric charge holding device. Preferably, the switching device includes a second switching element provided between an output of the electric charge holding device and the input of the inverting device and a third switching element provided between the output of the inverting device and the electric charge holding device. Preferably, in a case where a first state represents a state in which the second switching element is turned off and the third switching element is turned on and a second state represents a state in which the second switching element is turned on and the third switching element is turned off, the control device controls the second switching element and the third switching element to the second state at the holding period and controls the second switching element and the third switching element to perform one cycle operation for changing from the first state to the second state and then changing back to the first state once or more at the reading period.

According to the present invention, since the one cycle operation for changing from the first state to the second state and then changing back to the first state is performed once or more, the logical level of the input of the inverting device returns to its original logical level due to the one cycle operation, thus refreshing the electric charge stored in the electric charge holding device.

More specifically, it is preferable that the control device control the second switching element and the third switching element, such that the transition between the first state and the second state is performed via a third state that represents a state in which the second switching element and the third switching element are turned off.

According to the present invention, since the second and third switching elements are turned off at the transition between the first state and the second state, an operation margin can be allowed for. Thus, an oscillating state of the output of the inverting device caused by turning on of the second and third switching elements at the same time due to variation in the performance of elements and the like can be avoided.

Also, it is preferable that the electro-optical panel can further include fourth switching elements each provided between the output of the inverting device and the organic light-emitting diode. Preferably, the control device controls the fourth switching elements to an off state during the time at least from the start of the first state to the end of the one cycle operation at the reading period. In this case, since the output of the inverting device is disconnected from the organic light-emitting diode during the period when the output logical level of the inverting device is inverted, a problem in that the organic light-emitting diode to be originally turned off is inevitably turned on can be solved at this period, thus improving the contrast of a displayed image.

Furthermore, it is preferable that the inverting device be operated by a high potential source and a low potential source. It is also preferable that the electro-optical panel further include power supply device for supplying a first high potential, as the high potential source, and a first low potential, as the low potential source, to the inverting device at the holding period and for supplying a second high potential that is higher than the first high potential, as the high potential source, and a second low potential that is lower than the first low potential, as the low potential source, to the inverting device at the reading period.

According to the present invention, the potential of the high potential source at the reading period is higher than that at the holding period, and the potential of the low potential source at the reading period is lower than that at the holding period.

Since the output signal of the inverting device at the reading period has a larger amplitude than that at the holding period, an electric charge corresponding to the large amplitude is written to the electric charge holding device. The transition from the reading period to the holding period causes the second switching element to be turned on, and the electric charge is moved due to capacitive coupling of the electric charge holding device and the input capacitance of the inverting device. At this time, although the amplitude of the input signal of the inverting device is reduced, the inverting device can be correctly operated even with an input signal whose amplitude is reduced and leak current can be reduced since the supply voltage of the inverting device is reduced.

It is preferable that the inverting device include a P-channel thin film transistor and an N-channel thin film transistor. Preferably, the first to third switching elements are thin film transistors.

An electronic apparatus according to the present invention can include an electro-optical panel including a plurality of data lines, a plurality of scanning lines, and pixels provided in association with intersections of the data lines and the scanning lines, the pixels each including an organic light-emitting diode. The electronic, apparatus according to the present invention also includes a driving circuit for driving the electro-optical panel as described above. For example, a viewfinder used for a video camera, a portable telephone set, a notebook-sized personal computer, or the like corresponds to the electronic apparatus.

A driving method for driving an electro-optical panel including a plurality of data lines, a plurality of scanning lines, and pixels provided in association with intersections of the data lines and the scanning lines. The pixels can each include an organic light-emitting diode, electric charge holding device for holding an electric charge, an inverting device for outputting an output signal obtained by inverting an input signal, and switching device for switching a connection state of the electric charge holding device and the inverting device, output of the inverting device being supplied to the organic light-emitting diode, includes the steps of controlling the switching device such that the electric charge holding device is connected to an input of the inverting device and the electric charge holding device is not connected to an output of the inverting device at a holding period, and controlling the switching device such that the electric charge holding device is connected to the output of the inverting device an even number of times at a reading period.

According to the present invention, the electric charge holding device is connected to the output of the inverting device an even number of times at the reading period. Thus, an electric charge whose logical level is equal to its original logical level is stored in the electric charge holding device. Accordingly, data can be rewritten in a pixel by using a single inverting device. Thus, an electro-optical panel capable of significantly improving the aperture ratio and yield can be used.

Preferably, the electro-optical panel further includes first switching elements each provided between each of the data lines and the electric charge holding device. Preferably, the switching device includes a second switching element provided between the output of the electric charge holding device and the input of the inverting device and a third switching element provided between the output of the inverting device and the electric charge holding device. Preferably, the driving method further includes the steps of controlling the second switching element and the third switching element to a second state at the holding period, and controlling the second switching element and the third switching element to perform one cycle operation for changing from a first state to the second state and then changing back to the first state once or more at the reading period, where the first state represents a state in which the second switching element is turned off and the third switching element is turned on and the second state represents a state in which the second switching element is turned on and the third switching element is turned off.

According to the present invention, since the one cycle operation for changing from the first state to the second state and then changing back to, the first state is performed once or more, the logical level of the input of the inverting device returns to its original logical level due to the one cycle operation, thus refreshing an electric charge stored in the electric charge holding device.

Also, it is preferable that the driving method further include the step of controlling the second switching element and the third switching element such that the transition between the first state and the second state is performed via a third state that represents a state in which the second switching element and the third switching element are turned off.

According to the present invention, since the second and third switching elements are turned off at the transition between the first state and the second state, an operation margin can be allowed for. Thus, an oscillating state of the output of the inverting device caused by turning on of the second and third switching elements at the same time due to variation in the performance of elements and the like can be avoided.

Furthermore, it is preferable that the electro-optical panel further include fourth switching elements each provided between the output of the inverting device and the organic light-emitting diode. It is also preferable that the fourth switching elements be controlled to be turned off during the time at least from the start of the first state to the end of the one cycle operation at the reading period. In this case, since the output of the inverting device is disconnected from the organic light-emitting diode during the period when the output logical level of the inverting device is inverted, a problem in that the organic light-emitting diode to be originally turned off is inevitably turned on can be solved at this period, thus improving the contrast of a displayed image.

Furthermore, it is preferable that the inverting device be operated by a high potential source and a low potential source. It is also preferable that the driving method further include the steps of supplying a first high potential, as the high potential source, and a first low potential, as the low potential source, to the inverting device at the holding period, and supplying a second high potential that is higher than the first high potential, as the high potential source, and a second low potential that is lower than the first low potential, as the low potential source, to the inverting device at the reading period. According to the present invention, the potential of the high potential source at the reading period is higher than that at the holding period, and the potential of the low potential source at the reading period is lower than that at the holding period. Since the output signal of the inverting device at the reading period has a larger amplitude than that at the holding period, an electric charge corresponding to the large amplitude is written to the electric charge holding device.

The transition from the reading period to the holding period causes the second switching element to be turned on, and the electric charge is moved due to capacitive coupling of the electric charge holding device and the input capacitance of the inverting device. At this time, although the amplitude of the input signal of the inverting device is reduced, the inverting device can be correctly operated even with an input signal whose amplitude is reduced and leak current can be reduced since the supply voltage of the inverting device is reduced.

BRIEF DESCRIPTION OF THE DRAWINGS

The invention will be described with reference to the accompanying drawings, wherein like numerals reference like elements, and wherein.

DETAILED DESCRIPTION OF PREFERRED EMBODIMENTS

Figure 1:
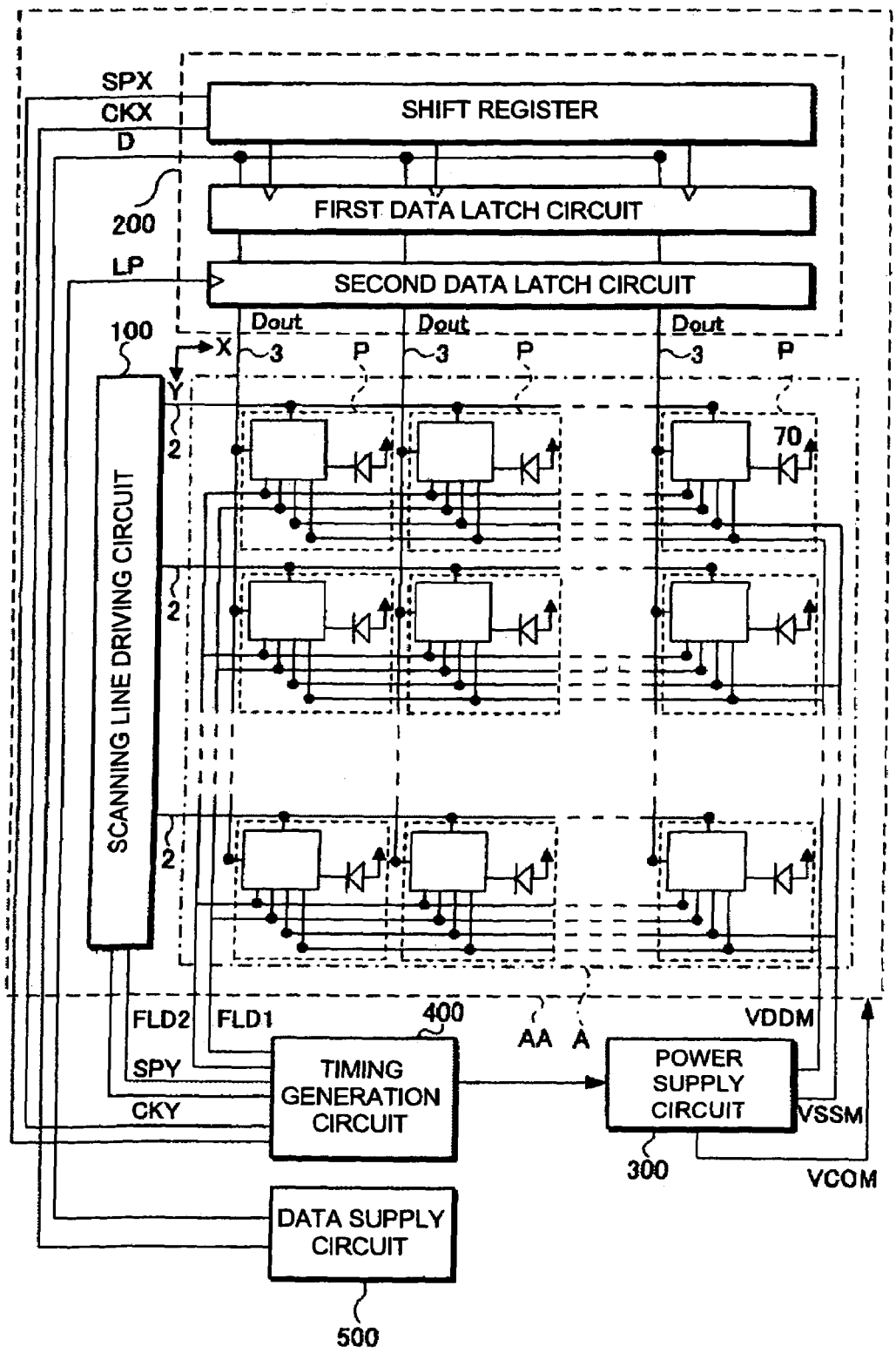
FIG. 1 is an exemplary block diagram showing the entire structure of an electro-optical device according to a first embodiment of the present invention.

To begin with, a device using OLED elements as electro-optical materials will be described as an example of an electro-optical device using an electro-optical panel according to the present invention. FIG. 1 is an exemplary block diagram showing the electrical structure of an electro-optical device according to a first embodiment of the present invention. The electro-optical device can include, as a principal part, an electro-optical panel AA, a power supply circuit 300, a timing generation circuit 400, and a data supply circuit 500.

The electro-optical panel AA includes an element substrate and a counter substrate. An image display area A, a scanning line driving circuit 100, and a data line driving circuit 200 are formed on the element substrate. These circuits are formed in the same process as transistors in the image display area A at the same time. The transistors are thin film transistors (hereinafter, referred to as "TFTs").

As shown in FIG. 1, in the image display area A, a plurality of scanning lines 2 are arranged in parallel in the X-direction and a plurality of data lines 3 are arranged in parallel in the Y-direction. Pixels P are arranged in a matrix near the respective intersections of the scanning lines 2 and the data lines 3. The details of the pixels P will be described below. Each of the pixels P includes an OLED element 70.

The timing generation circuit 400 generates various timing signals and supplies them to the electro-optical panel AA and the power supply circuit 300. A first field signal FLD1 and a second field signal FLD2 are signals having a period of one field. The first field signal FLD1 and the second field signal FLD2 control predetermined transistors constituting each of the pixels P. An X scanning start pulse SPX instructs to start horizontal scanning. The X scanning start pulse SPX is a pulse that has a period of one horizontal scanning operation and that is active at a high level. An X clock signal CKX is a signal in synchronization with image data D.

A Y scanning start pulse SPY is a pulse that instructs to start vertical scanning and that is active at a high level. A Y clock signal YCK is a signal having a period of two horizontal scanning operations.

The power supply circuit 300 can include constant-voltage sources (not illustrated) for generating a first high potential VDD, a second high potential VHH, a first low potential VSS, and a second low potential VLL and a selection circuit (not illustrated). In accordance with a control signal sent from the timing generation circuit 400, the selection circuit selects either one of the first high potential VDD and the second high potential VHH and outputs it as a high potential source VDDM, and at the same time, selects either one of the first low potential VSS and the second low potential VLL and outputs it as a low potential source VSSM. More specifically, at a predetermined period, the second high potential VHH is output as the high potential source VDDM and at the same time, the second low potential VLL is output as the low potential source VSSM, and at the other period, the first high potential VDD is output as the high potential source VDDM and at the same time, the first low potential VSS is output as the low potential source VSSM. The high potential source VDDM and the low potential source VSSM are supplied to each of the pixels P. Also, a common electrode is arranged over the entire surface that is opposite to the display surface of the electro-optical panel AA, and the power supply circuit 300 supplies a common electrode potential VCOM to the common electrode. Moreover, the power supply circuit 300 supplies predetermined power to the scanning line driving circuit 100, the data line driving circuit 200, the timing generation circuit 400, and the data supply circuit 500.

The scanning line driving circuit 100 includes a shift register (not illustrated) and sequentially shifts the Y scanning start pulse SPY in accordance with the Y clock signal YCK to generate a scanning signal WRT. Here, the Y scanning start pulse SPY and the Y clock signal YCK are not always supplied. The Y scanning start pulse SPY and the Y clock signal YCK are supplied only in a case where the display is changed and output image data Dout to be stored in the pixels P must be rewritten.

The data line driving circuit 200 can include a shift register, a first data latch circuit group, and a second data latch circuit group. The shift register sequentially shifts the X scanning start pulse SPX in synchronization with the X clock signal CKX, generates a sampling pulse for sampling the image data D, and supplies the sampling pulse to the first data latch circuit group. The first data latch circuit group latches the image data D in accordance with the sampling pulse and samples dot-sequential data. The second data latch circuit group latches the dot-sequential data in accordance with a latch pulse LP and generates line-sequential data. The line-sequential data is 1-bit output image data Dout.

Figure 2:
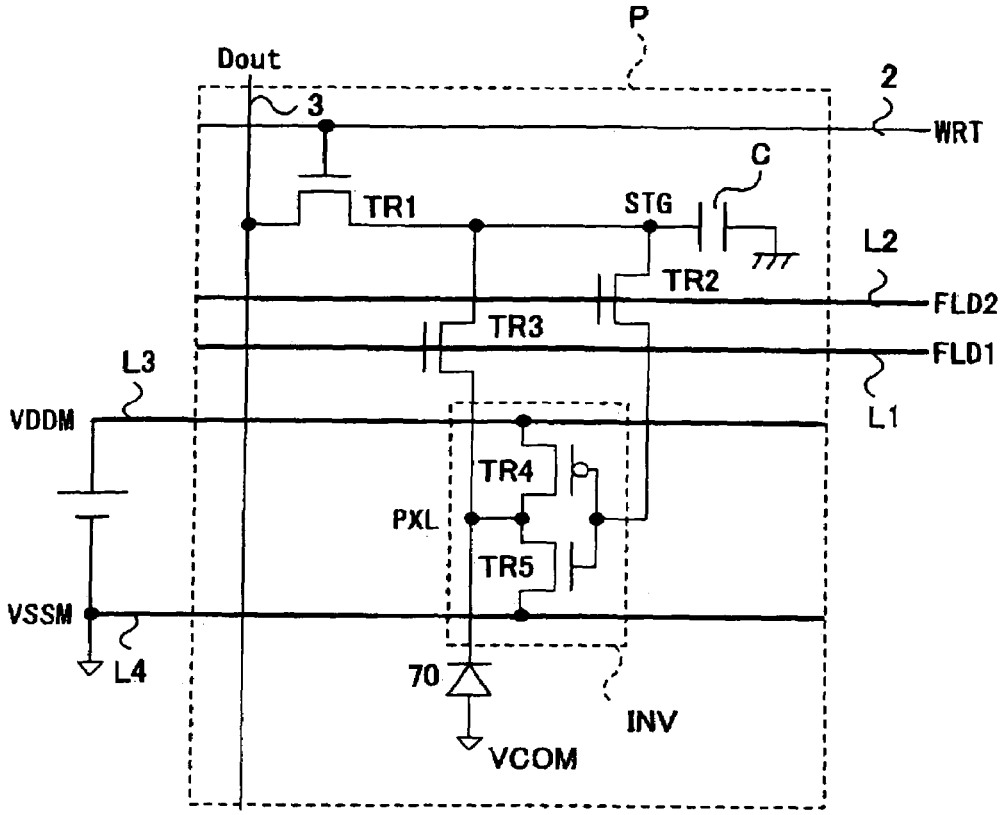
FIG. 2 is an exemplary circuit diagram of one of pixels P constituting an electro-optical panel AA in the electro-optical device.

FIG. 2 is an exemplary circuit diagram showing the structure of one of the pixels P. As shown in the drawing, the pixel P includes a first transistor TR1, a second transistor TR2, a third transistor TR3, an inverter INV, a hold capacitor C, and the OLED element 70. The inverter INV functions as an inverting circuit and includes a fourth transistor TR4 and a fifth transistor TR5. These transistors function as switching elements and are formed by TFTs.

The source of the first transistor TR1 is connected to the data line 3, the gate of the first transistor TR1 is connected to the scanning line 2, and the drain of the first transistor TR1 is connected to one terminal of the hold capacitor C. Thus, when the scanning signal WRT supplied via the scanning line 2 is at the high level (active), the potential of the data line 3 is captured in the hold capacitor C via the first transistor TR1. Thus, an electric charge corresponding to the output image data Dout is stored in the hold capacitor C. Here, although the other terminal of the hold capacitor C is grounded in this example, the other terminal of the hold capacitor C may be connected to a second control line L2, in consideration of the element layout.

The second transistor TR2 is provided between the hold capacitor C and an input of the inverter INV. The source of the second transistor TR2 is connected to the one terminal of the hold capacitor C, the drain of the second transistor TR2 is connected to the input of the inverter INV, and the second field signal FLD2 is supplied to the gate of the second transistor TR2 via the second control line L2. The third transistor TR3 is provided between the hold capacitor C and an output of the inverter INV. The source of the third transistor TR3 is connected to the one terminal of the hold capacitor C, the drain of the third transistor TR3 is connected to the output of the inverter INV, and the first field signal FLD1 is supplied to the gate of the third transistor TR3 via a first control line L1. The second transistor TR2 and the third transistor TR3 function as switching device for switching the connection state between the hold capacitor C and the inverter INV. The output of the inverter INV is also connected to the cathode of the OLED element 70. The anode of the OLED element 70 is connected to a counter electrode. Furthermore, the high potential source VDDM and the low potential source VSSM are supplied to the inverter INV via power supply lines L3 and L4.

The anode and cathode of the OLED element 70 may be connected in the opposite way to that described above in accordance with a production method of the layered structure. In this case, only the logic of data corresponding to an image signal to be written or to be held is reversed, and there is no change in other respects.

Driving operations, a reading operation and a writing operation, of the electro-optical panel AA will now be described individually. The writing operation is to write the output image data Dout to the pixels P via the data lines 3. The reading operation is to rewrite the output image data Dout, which has been written to the pixels P, and to hold the output image data Dout in the pixels P.

To begin with, the reading operation will be described. For the reading operation, since there is no need to capture the potential of the data line 3 in the pixel P, the scanning signal WRT is set to be inactive and the first transistor TR1 is turned off.

Figure 3:
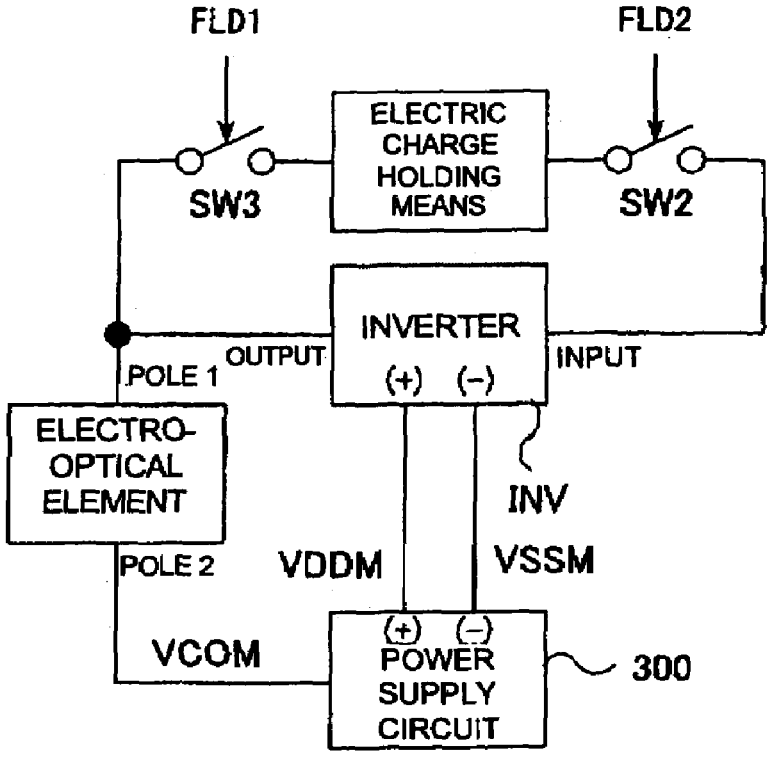
FIG. 3 is an exemplary block diagram showing an equivalent circuit of the pixel P and its peripheral structure for a reading operation in the electro-optical panel.
Figure 4:
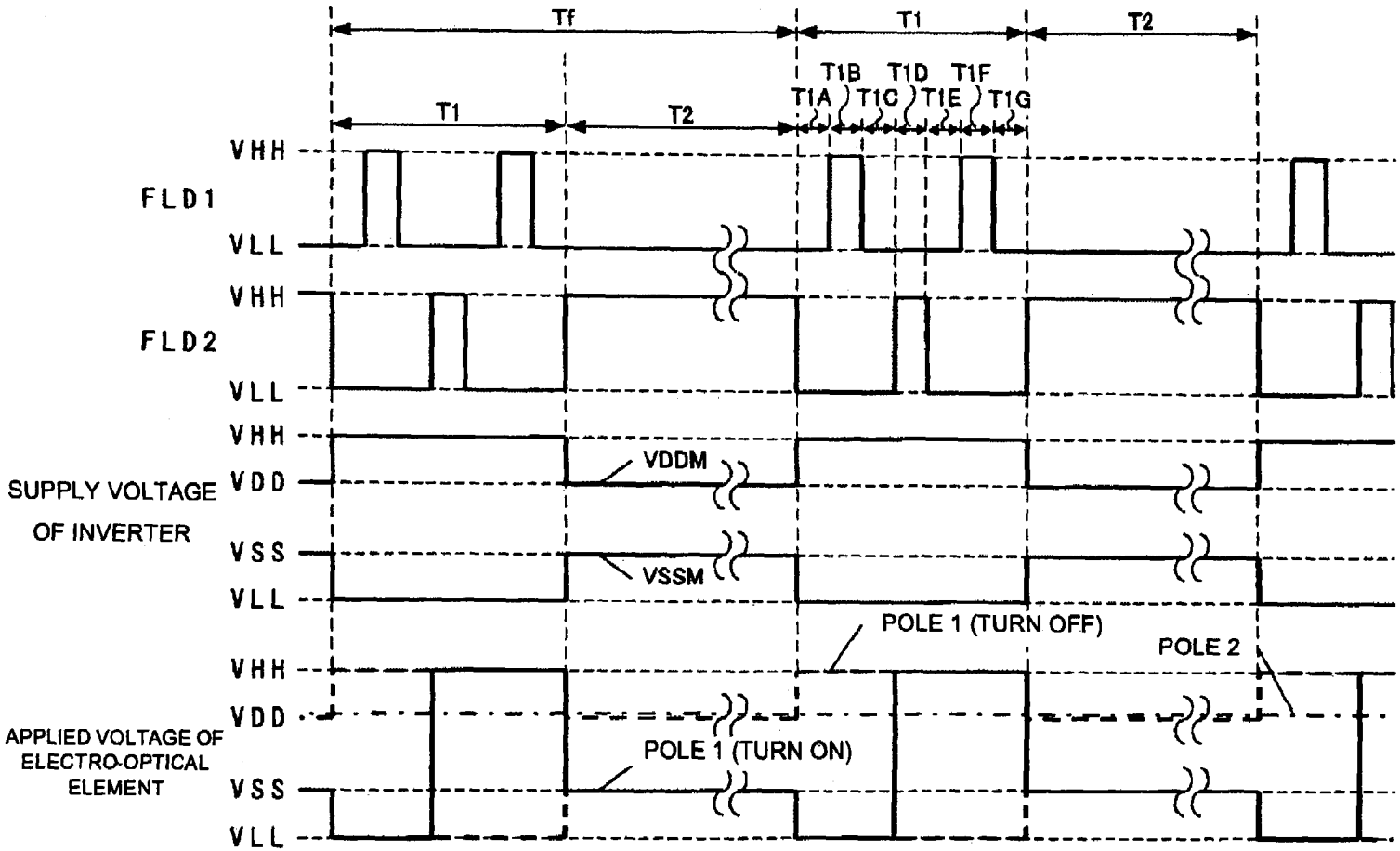
FIG. 4 is a timing chart for the reading operation in the equivalent circuit shown in FIG. 3.

FIG. 3 shows an equivalent circuit of the pixel P shown in FIG. 2 and its peripheral structure for the reading operation. In the drawing, a switch SW2 corresponds to the second transistor TR2 and a switch SW3 corresponds to the third transistor TR3. Also, electric charge holding device can correspond to the hold capacitor C and an electro-optical element corresponds to the OLED element 70. FIG. 4 is a timing chart for the reading operation in the equivalent circuit shown in FIG. 3. As shown in the drawing, one field period T1 for the reading operation is composed of a reading period T1 and a holding period T2.

The reading, period T1 is set to be shorter than the holding period T2. During the reading period T1, power is consumed for rewriting an electric charge, as described below. In contrast, during the holding period T2, little power is consumed. Thus, power consumption can be reduced by setting the reading period T1 to be shorter than the holding period T2.

First, at a period T1A of the reading period T1, the first field signal FLD1 and the second field signal FLD2 are inactive (at a low level). At this time, the electric charge holding device (hold capacitor C) is disconnected from the inverter INV and the electro-optical element (OLED element 70), and a predetermined electric charge is stored in an input capacitor of the inverter INV. In this case, the input logical level of the inverter INV is in the same state as that before turning off the switch SW2.

Next, at a period T1B, the first field signal FLD1 becomes active (at a high level), while the second, field signal FLD2 remains inactive.

At this time, the switch SW3 is turned on, and the electric charge holding device (hold capacitor C) is connected to the output of the inverter INV and the electro-optical element (OLED element 70). Since the output logical level of the inverter INV is the inverse of the logical level, an electric charge indicating a logical level that is the inverse of the previous logical level is written to the electric charge holding device.

Next, at a period T1C, the first field signal FLD1 and the second field signal FLD2 are inactive. Thus, the electric charge holding device (hold capacitor C) is, disconnected from the inverter INV and the electro-optical element (OLED element 70). At a period T1D, the second field signal FLD2 becomes active, while the first field signal FLD1 remains inactive. At this time, the switch SW2 is turned on, and the electric charge holding device (hold capacitor C) is connected to the input of the inverter INV. Accordingly, an electric charge that inverts the logical level is written to the input capacitor of the inverter INV.

Next, at a period T1E, the first field signal FLD1 and the second field signal FLD2 are inactive, and the electric charge holding device (hold capacitor C) is disconnected from the inverter INV and the electro-optical element (OLED element 70). At a period T1F, the first field signal FLD1 becomes active, while the second field signal FLD2 remains inactive. At this time, the switch SW3 is turned on, and the electric charge holding device (hold capacitor C) is connected to the output of the inverter INV. Thus, an electric charge that further inverts the logical level is written to the electric charge holding device. Consequently, by the two writing operations performed at the periods T1B and the T1F, the logical level of the electric charge holding device returns to the logical level before the start of the reading period T1.

Then, at a period T1G, the first field signal FLD1 and the second field signal FLD2 are inactive. Thus, the electric charge holding device (hold-capacitor C) is disconnected from the inverter INV and the electro-optical element (OLED element 70).

As described above, at the reading period T1, the connection of the electric charge holding device and the inverter INV is performed an even number of times. Thus, an electric charge indicating an original logical level can be written to the electric charge holding device, and data can be stored without inverting the logical level even in a structure in which a latch circuit is not provided in the pixel P. As a result of this, the number of elements constituting the pixel P can be reduced, thus improving the aperture ratio and yield.

Also, a state in which the switch SW2 is turned off and the switch SW3 is turned on is represented by a first state and a state in which the switch SW2 is turned on and the switch SW3 is turned off is represented by a second state. In this case, performing the connection of the electric charge holding device and the inverter INV an even number of times can mean that one cycle operation for changing from the first state to the second state and then changing back to the first state is performed once or more. Although the one cycle operation is performed once in this example, it is obvious that the one cycle operation may be performed a plurality of times.

Also, in a case where a state in which the switch SW2 and the switch SW3 are turned off is represented by a third state, the transition between the first state and the second state is performed via the third state. The third state is required for avoiding an oscillating state caused by feedback of the output of the inverter INV to the input thereof in a case where the switch SW2 and the switch SW3 are turned on at the same time.

Next, at the holding period, T2, the second field signal FLD2 is shifted from the inactive state (low level) to the active state (high level), while the first field signal FLD1 remains in the inactive state. At this time, the switch SW2 is turned on, and the electric charge holding device is connected to the input of the inverter INV. Since, at the reading period T1, the final logical level of the electric charge holding device is equal to the logical level before the start of the reading period T1, the potential of a pole 1 of the electro-optical element (OLED element 70) at the holding period T2 is equal to that before the start of the reading period T1. In contrast, the potential of a pole 2 is constant all through the reading period T1 and the holding period T2. Thus, the polarity of a voltage applied to the electro-optical element is not changed. Consequently, an organic light-emitting diode can be used as the electro-optical element.

Here, the high potential source VDDM and the low potential source VSSM are supplied to the inverter INV. At the reading period T1, the high potential source VDDM is the second high potential VHH and the low potential source VSSM is the second low potential VLL. Then, at the holding period T2, the high potential source VDDM is the first high potential VDD and the low potential, source VSSM is the first low potential VSS. In other words, the supply voltage of the inverter INV at the reading period T1 is increased as compared with that at the holding period T2 thus, the fourth transistor TR4 and the fifth transistor TR5 constituting the inverter INV are capable of performing an inverting operation without malfunction. This respect will be described with reference to FIG. 5.

Figure 5:
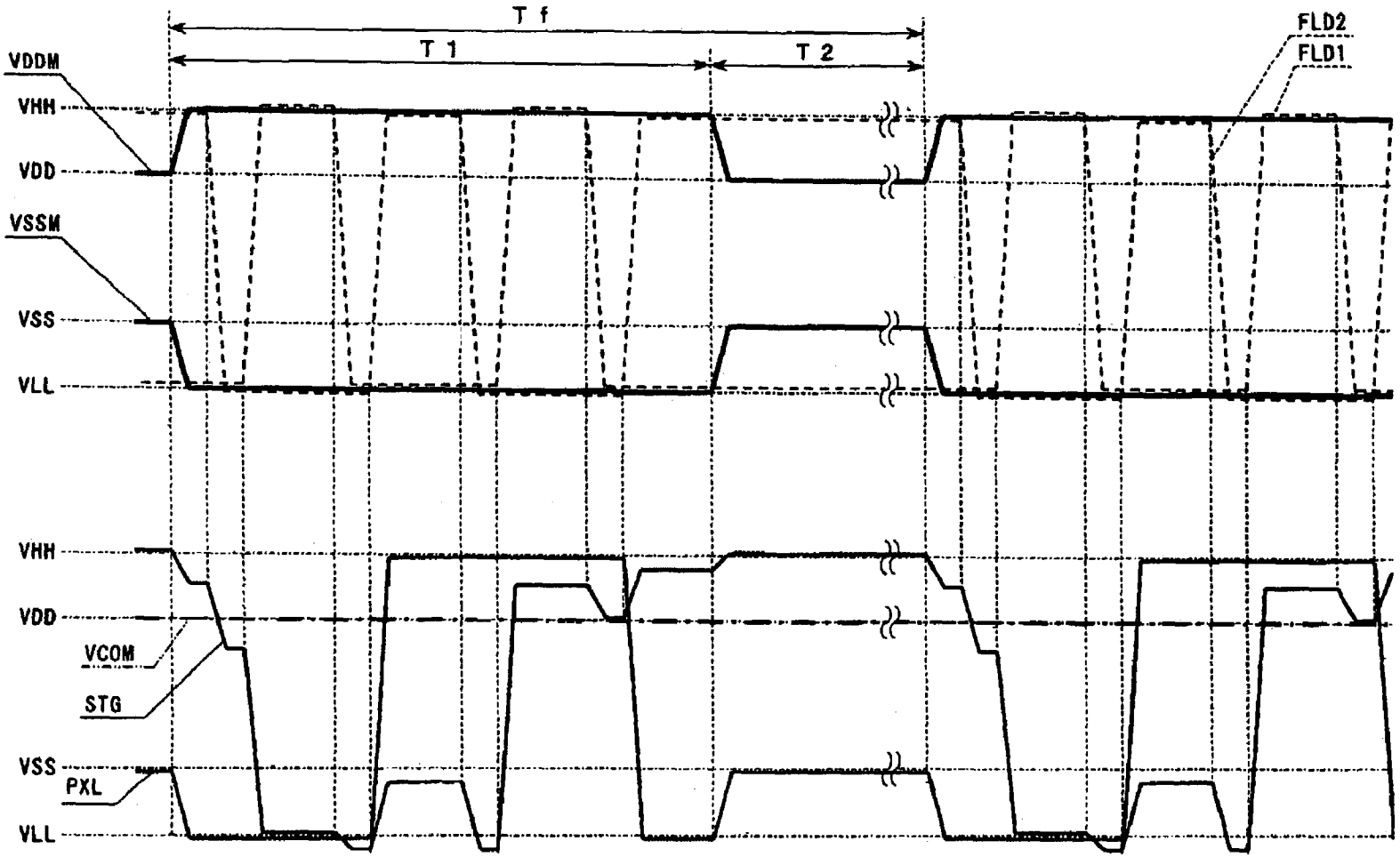
FIG. 5 is a detailed timing chart showing the potential of the pixel P in each section.

FIG. 5 is a detailed timing chart showing the potential of the pixel P in each section. In the drawing, "STG" is a symbol representing the potential (hereinafter, referred to as a holding potential) of the node between the hold capacitor C and the second and third transistors TR2 and TR3, and "PXL" is a symbol representing the output potential of the inverter INV.

Here, the capacitance value of the hold capacitor C is represented by Ch1, and the input capacitance of the inverter INV is represented by Cin. Assuming that, at the reading period T1, the high potential source VDDM is the first high potential VDD, the low potential source VSSM is the first low potential VSS, and the holding potential STG is at a high level, in other words, STG=VDD, an electric charge quantity Q stored in the hold capacitor C immediately before the end of the reading period T1 is represented by the condition Q=Ch1·VDD.

Then, the transition from the reading period T1 to the holding period T2 causes the second transistor TR2 to be changed from the off state to the on state, and capacitive coupling between the hold capacitor C and the input capacitance Cin is achieved. When the electric charge stored in the hold capacitor C is moved to the input capacitance Cin, the input potential V of the inverter INV is represented by the condition V=Ch1·VDD/(Ch1+Cin). In other words, the input potential V of the inverter INV is lower than the first high potential VDD. Thus, the off resistance of the fourth transistor TR4 constituting the inverter INV is reduced. This causes the fourth transistor TR4 not to be in a complete off state, thus causing leak current and susceptibility of malfunction.

In contrast, in this embodiment, the high potential source VDDM is the second high potential VHH and the low potential source VSSM is the second low potential VLL at the reading period T1. Thus, the electric charge quantity Q stored in the hold capacitor C immediately before the end of the reading period T1 is represented by the condition Q=Ch1·VHH. Also, when the capacitive coupling between the hold capacitor C and the input capacitance Cin is achieved due to the transition from the reading period T1 to the holding period T2, the input potential V of the inverter INV is represented by the condition V=Ch1·VHH/(Ch1+Cin).

Since the second high potential VHH is higher than the first high potential VDD, the input potential V can be set to be higher than a case where the supply voltage of the inverter INV is not increased at the reading period T1. Thus, a reduction in the off resistance of the fourth transistor TR4 can be prevented, thus reducing a leak current value and improving the reliability.

In order to maintain the off state of the fourth transistor TR4, it is preferable that the condition |Vth4|>|Ch1·VHH/(Ch1+Cin)−VDD| be satisfied, where Vth4 represents a threshold voltage of the fourth transistor TR4. In this case, since the voltage between the gate of the fourth transistor TR4 and the source of the fourth transistor TR4 is lower than the threshold voltage Vth4, the off state of the fourth transistor TR4 can be ensured.

Also, in order to maintain the off state of the fifth transistor TR5, it is preferable that the condition |Vth5|>|Ch1·VLL/(Ch1+Cin)−VSS| be satisfied, where Vth5 represents a threshold voltage of the fifth transistor TR5. In this case, since the voltage between the drain of the fifth transistor TR5 and the gate of the fifth transistor TR5 is lower than the threshold voltage Vth5, the off state of the fifth transistor TRS can be ensured.

In the example shown in FIG. 5, since the holding voltage STG (input voltage V) is higher than the first high potential VDD at the holding period T2, the off state of the fourth transistor TR4 can be ensured.

The writing operation will now be described. For the writing operation, since the potential of the data line 3 must be captured in the pixel P, the scanning signal WRT is set to be active and the first transistor TR1 is turned on.

Figure 6:
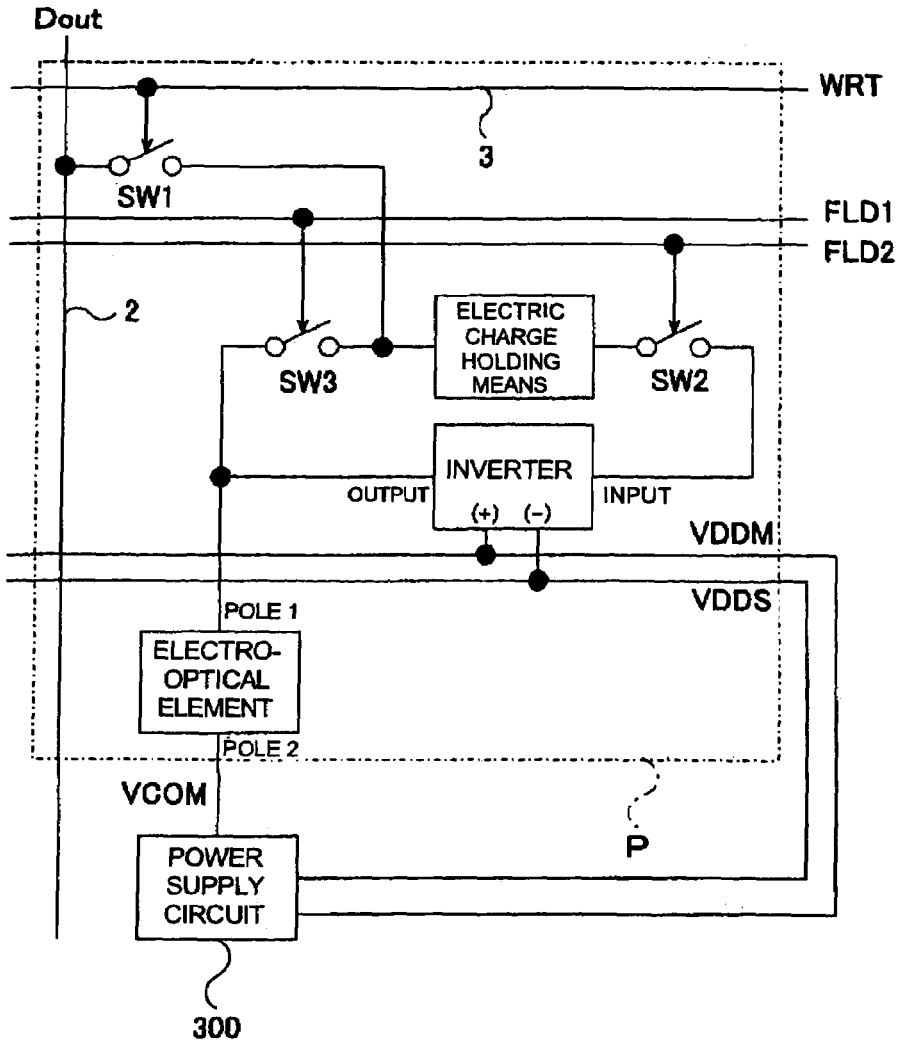
FIG. 6 is an exemplary block diagram showing an equivalent circuit of the pixel P and its peripheral structure for a writing operation in the electro-optical panel.
Figure 7:
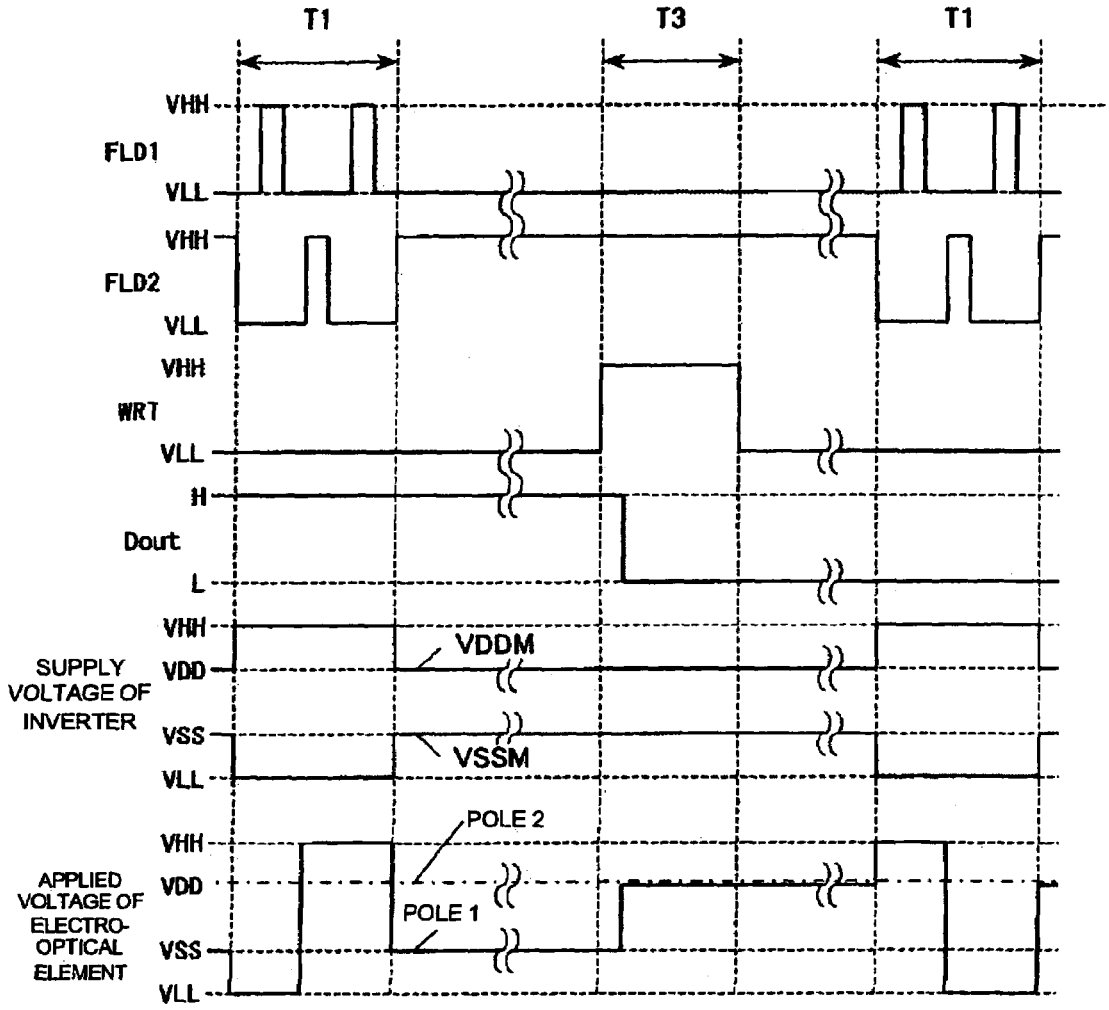
FIG. 7 is a timing chart for the writing operation in the equivalent circuit shown in FIG. 6.

FIG. 6 shows an equivalent circuit of the pixel P shown in FIG. 2 and its peripheral structure for the writing operation. In the drawing, a switch SW1 corresponds to the first transistor TR1. FIG. 7 is a timing chart including the writing operation in the equivalent circuit shown in FIG. 6.

In this example, at a writing period T3, the output image data Dout is written to the pixel P. The writing operation is performed only when data stored in the pixel P must be rewritten. Since rewriting is performed by the reading operation described above, a voltage applied to the electro-optical element is not reduced due to leak current. Thus, if there is no need to rewrite data, the writing operation is appropriately omitted. Accordingly, the number of times capacitive loads, such as the scanning line 2 and the data line 3, are driven can be reduced, thus reducing power consumption.

At the writing period T3, the scanning signal WRT is active and the switch SW1 (first-transistor TR1) is turned on. Then, the output image data Dout is captured in the pixel P via the data line 3. At this time, the logical level of the output image data Dout is captured as an electric charge in the electric charge holding device. In this example, at time t1, the logical level of the output image data Dout is shifted from a high level to a low level. At this time, the output (the pole 1) of the inverter INV is changed from the first low potential VSS to the first high potential VDD and the electric charge held in the electric charge holding device is rewritten.

The writing operation performed as described above significantly reduces power consumption.

An electro-optical device according to a second embodiment is arranged in a similar way to the electro-optical device according to the first embodiment shown in FIG. 1 with the exception of the structure of pixels P', the details of driving waveforms of the pixels P', and generation of a control signal VOFF in the timing generation circuit 400.

Figure 8:
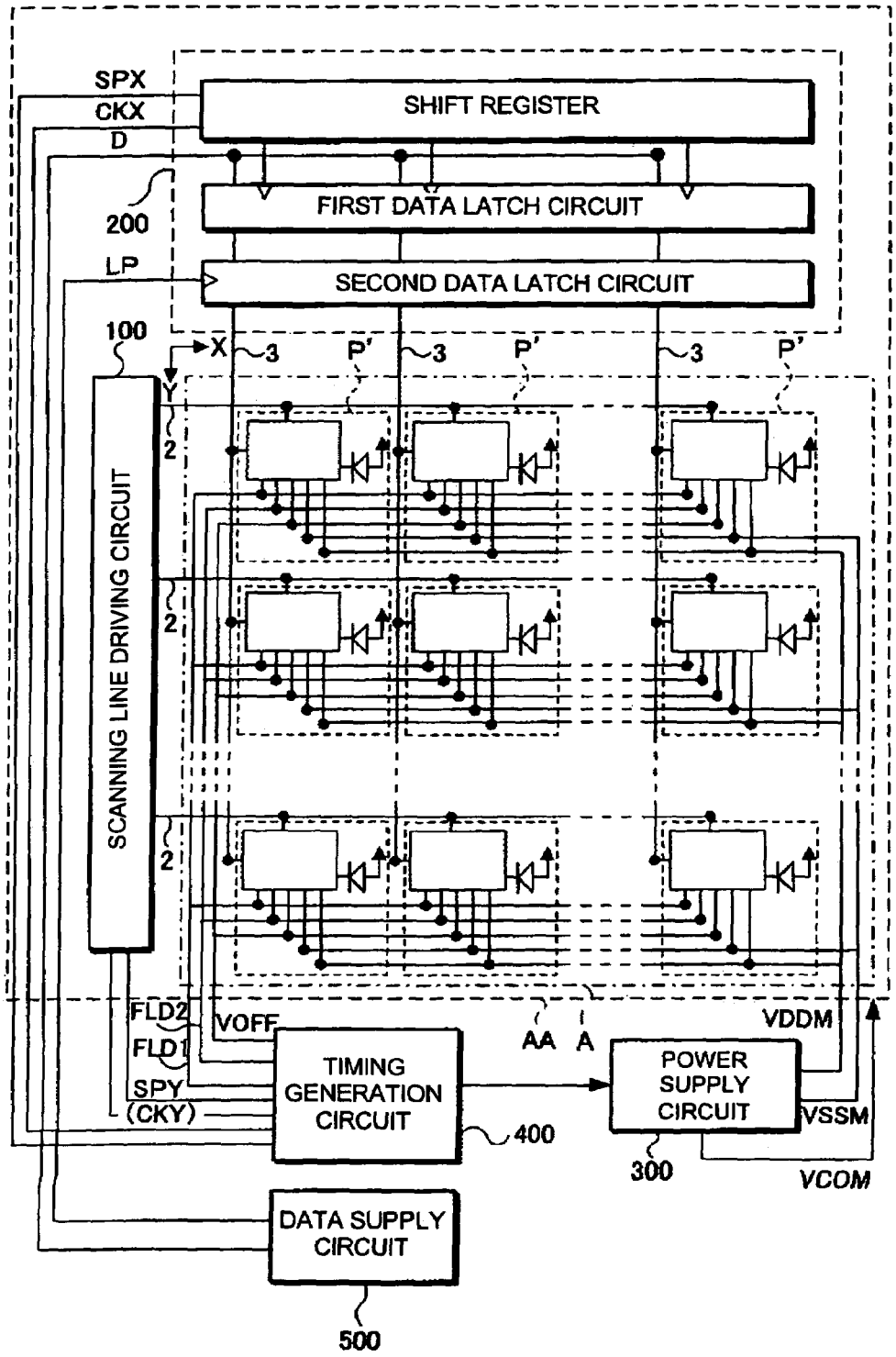
FIG. 8 is an exemplary block diagram showing the entire structure of an electro-optical device according to a second embodiment of the present invention.
Figure 9:
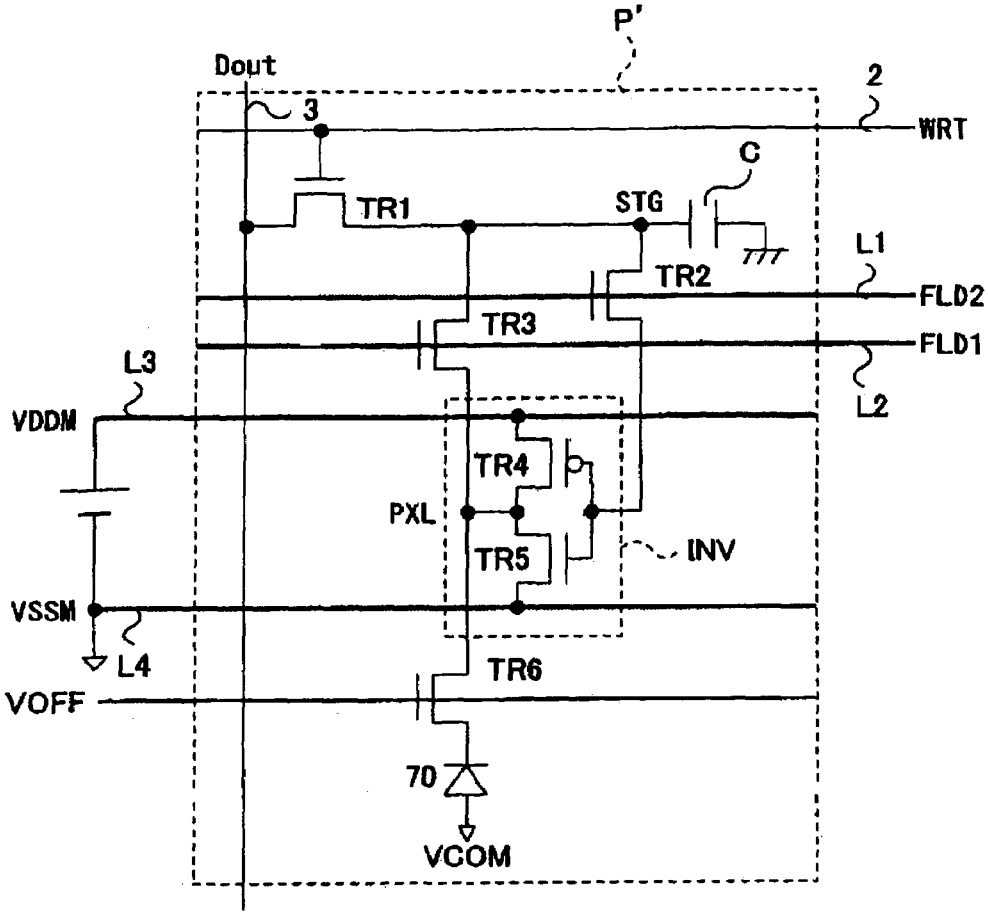
FIG. 9 is an exemplary circuit diagram of one of pixels P' constituting the electro-optical panel AA used in the second embodiment.

FIG. 8 is an exemplary block diagram showing the entire structure of the electro-optical device according to the second embodiment. FIG. 9 is an exemplary circuit diagram showing the structure of one of pixels P' provided in the electro-optical panel AA according to the second embodiment. The pixel P' is arranged in a similar way to the pixel P according to the first embodiment shown in FIG. 2, with the exception of a sixth transistor TR6 provided between the output of the inverter INV and the OLED element 70.

Figure 10:
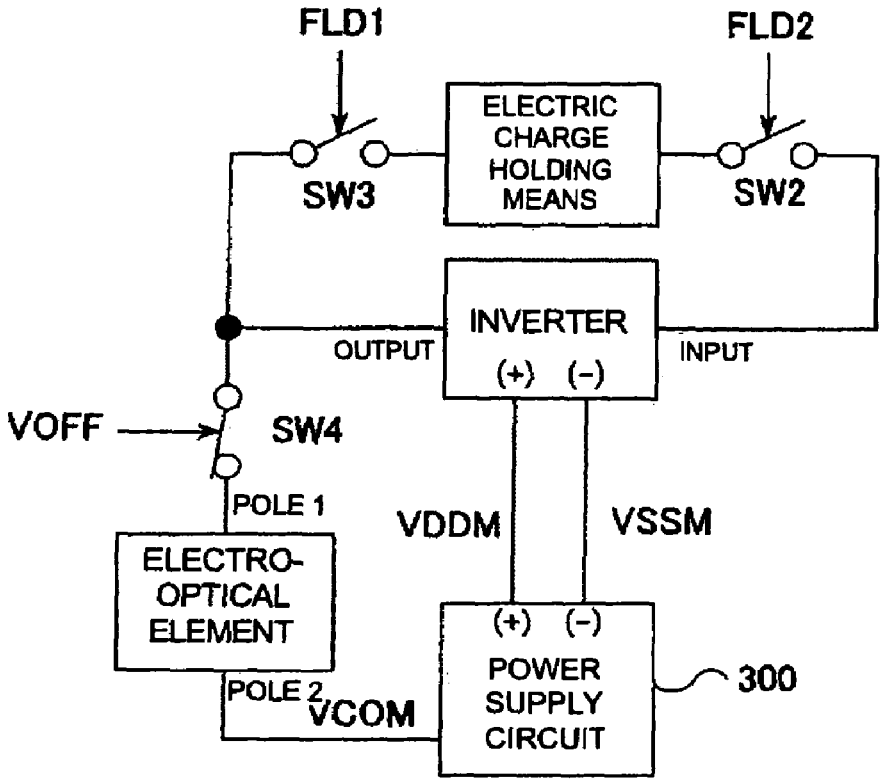
FIG. 10 is an exemplary block diagram showing an equivalent circuit of the pixel P' and its peripheral structure for the reading operation in the electro-optical panel.

FIG. 10 shows an equivalent circuit of the pixel P' shown in FIG. 9 and its peripheral structure for the reading operation. In the drawing, a switch SW4 corresponds to the sixth transistor TR6.

Figure 11:
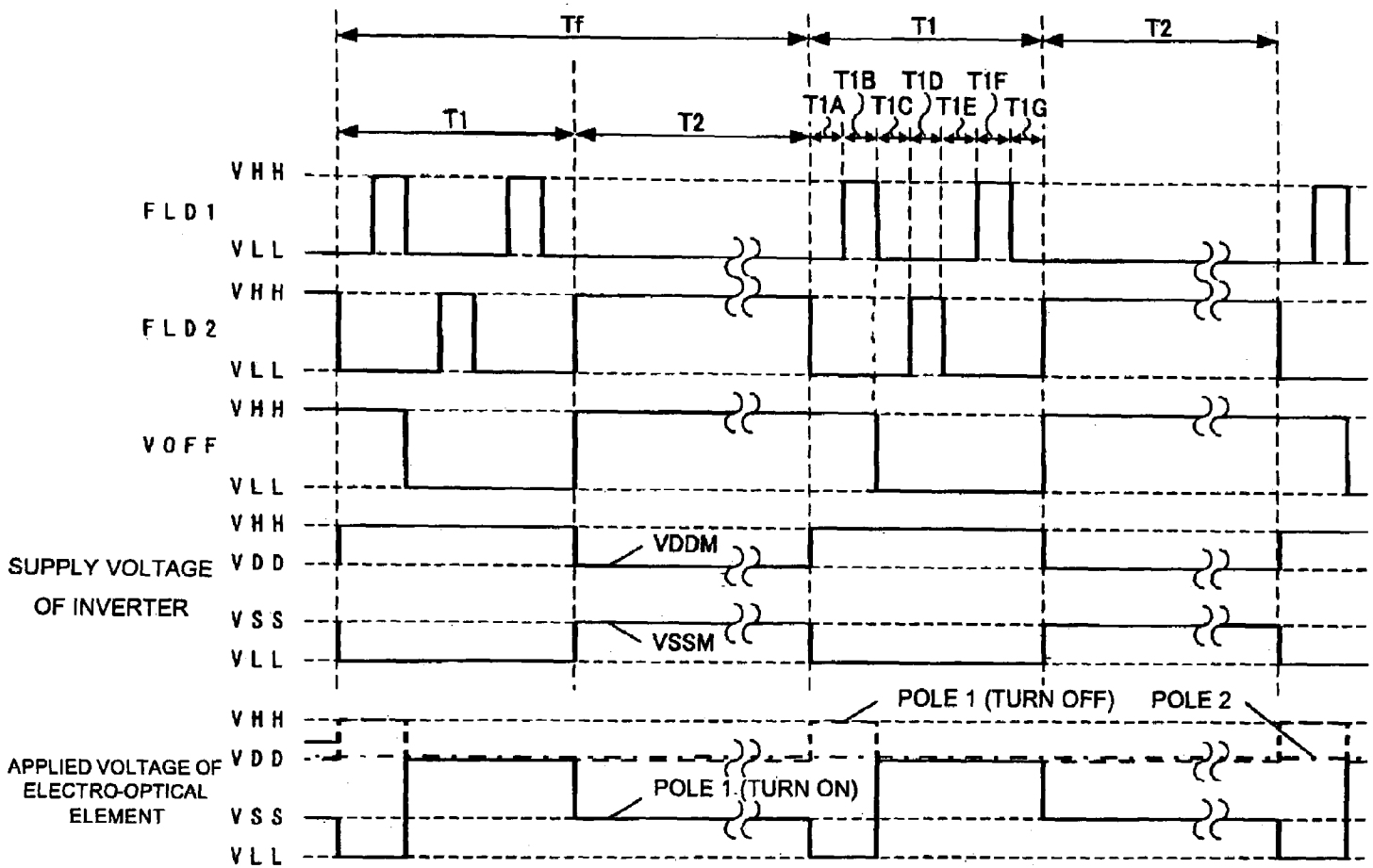
FIG. 11 is a timing chart for the reading operation in the equivalent circuit shown in FIG. 10.

The reading operation and the writing operation of the electro-optical panel AA will be described individually. FIG. 11 shows signal waveforms of the first field signal FLD1 and the second field signal FLD2 and voltage waveforms of the high potential source VDDM and the low potential source VSSM for the reading operation.

FIG. 11 is different from FIG. 4 in that the control signal VOFF is active (at a low level) during the time from the start of the period T1C to the end of the reading period T1. Thus, the switch SW4 is turned off, and the output of the inverter INV is disconnected from the electro-optical element. The disconnection of the inverter INV from the electro-optical element is performed for the reason described below.

As described in the first embodiment, at the period T1B, the switch SW3 is turned on, and the electric charge holding device is connected to the inverter INV. Thus, an electric charge that inverts the logical level is written to the electric charge holding device. Then, when the switch SW2 is turned on at the period T1D, the output logical level of the inverter INV is inverted. Thus, in the first embodiment, as shown in FIG. 4, during the time from the start of the period T1D to the end of the reading period T1, pixels to be originally turned off, in other words, black pixels (or pixels to be originally turned on, in other words, white pixels) are inevitably turned on, in other words, white pixels (or turned off, in other words, black pixels). Thus, the contrast is reduced. Therefore, in order to increase the contrast, the output of the inverter INV must be disconnected from the electro-optical element during the time at least from the start of the period T1D to the end of the reading period T1.

Thus, in the second embodiment, the switch SW4 is turned off during the time from the start of the period T1D to the end of the reading period T1 so that the output of the inverter INV is disconnected from the electro-optical element.

Although it is sufficient that the control signal VOFF becomes active at the start of the period T1D and the switch SW4 is thus turned off, the control signal VOFF becomes active at the start of the period T1C, allowing for a margin, in this embodiment.

Figure 12:
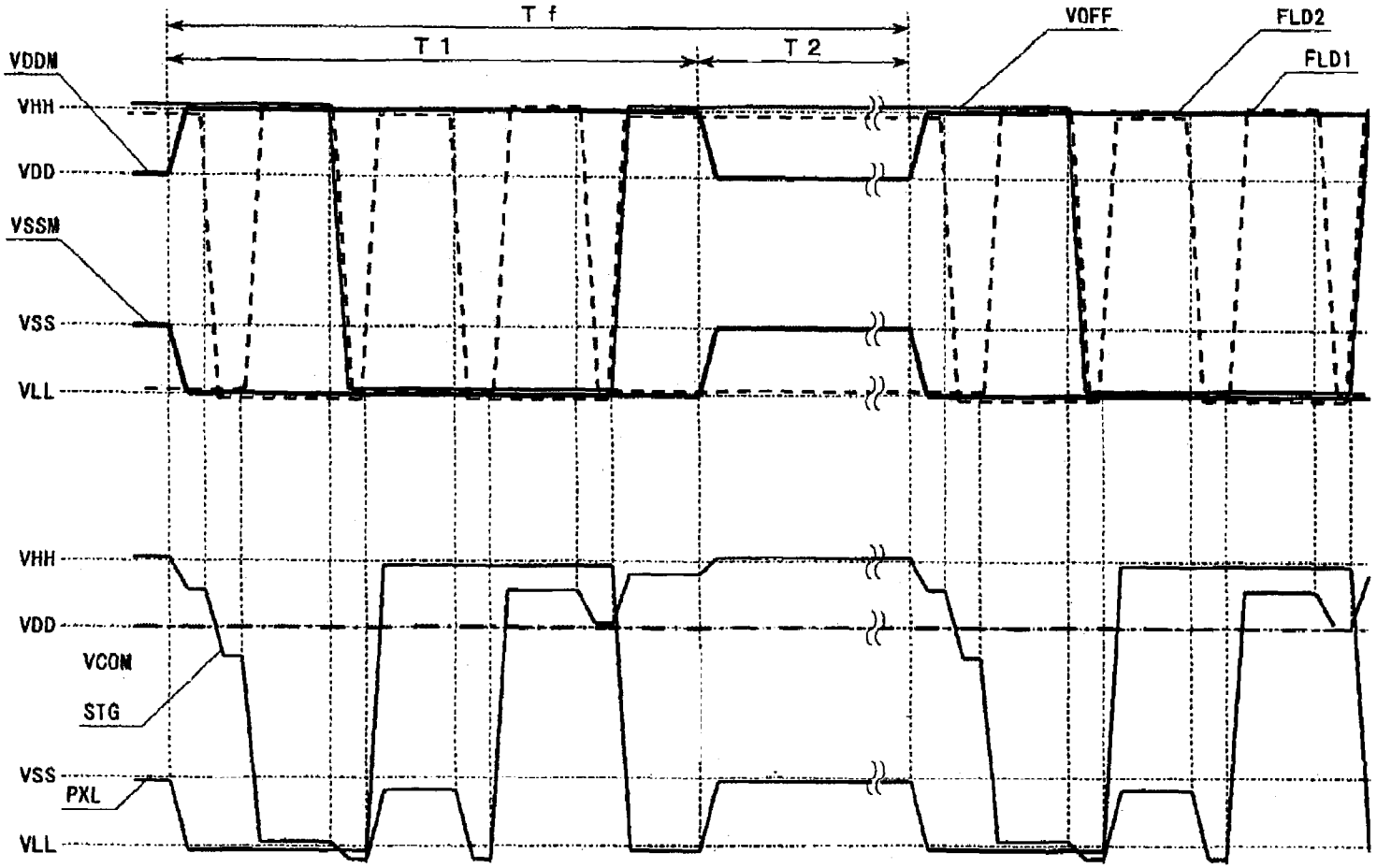
FIG. 12 is a detailed timing chart showing the potential of the pixel P' in each section.

FIG. 12 is a detailed timing chart showing the potential of the pixel P' in each section. In the second embodiment, the high potential source VDDM and the low potential source VSSM are supplied to the inverter INV, as in the first embodiment. At the reading period T1, the high potential source VDDM is the second high potential VHH and the low potential source VSSM is the second low potential VLL. At the holding period T2, the high potential source VDDM is the first high potential VDD and the low potential source VSSM is the first low potential VSS. This causes the input potential V of the inverter INV to be high at the reading period T1. Thus, a reduction in the off resistance of the fourth transistor TR4 and the fifth transistor TR5 is prevented. Therefore, a leak current value is reduced and the reliability is increased.

It is preferable that the relationship of the threshold voltage Vth4 of the fourth transistor TR4 and the first and second high potentials VDD and VHH satisfy the condition $|Vth4|>|Ch1\cdot VHH/(Ch1+Cin)-VDD|$, as in the first embodiment described above. Also, it is preferable that the relationship of the threshold voltage Vth5 of the fifth transistor TR5 and the first and second low potentials VSS and VLL satisfy the condition, $|Vth5|>|Ch1\cdot VLL/(Ch1+Cin)-VSS|$, as in the first embodiment described above.

The writing operation will now be described. For the writing operation, since the potential of the data line 3 must be captured in the pixel P', the scanning signal WRT is set to be active and the first transistor TR1 is turned on.

Figure 13:
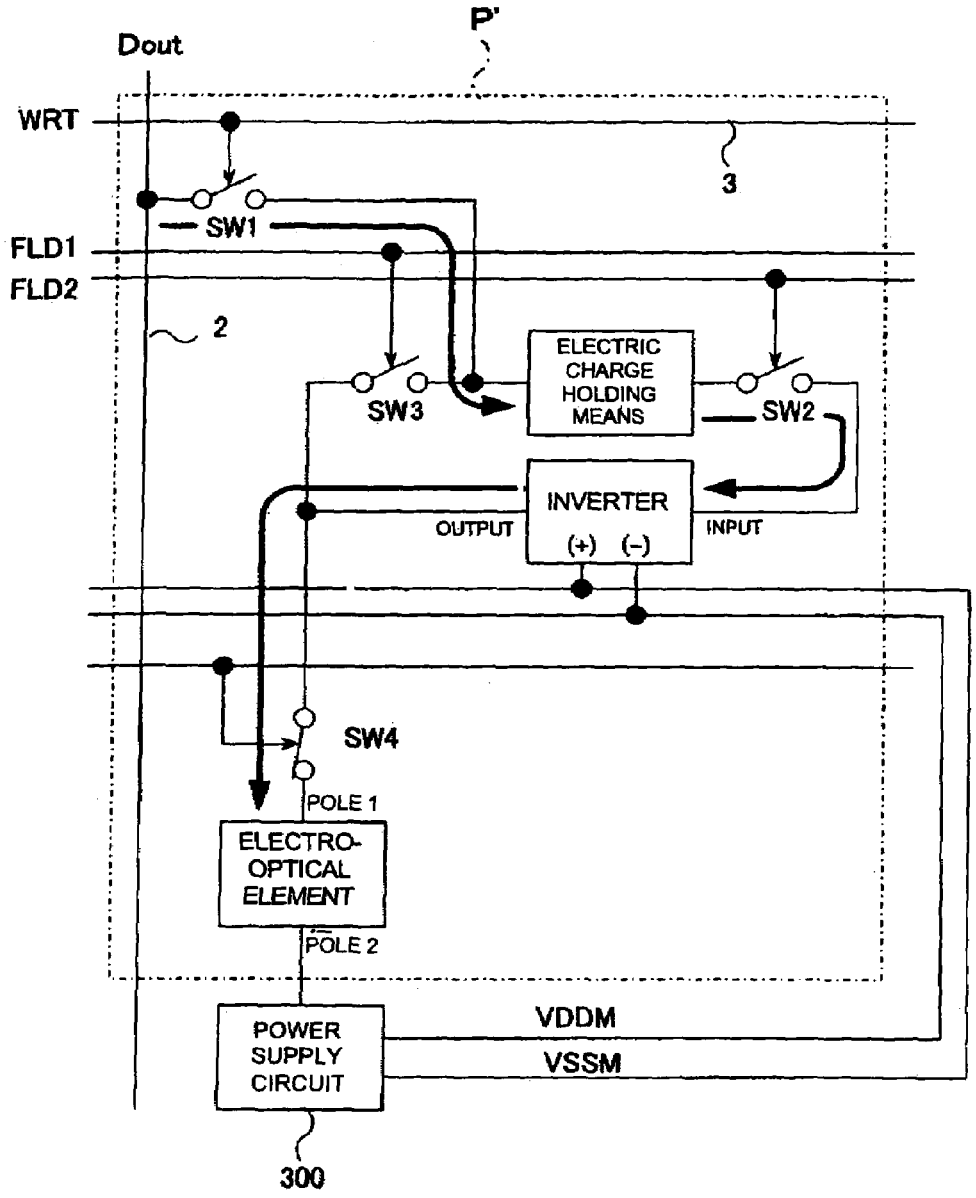
FIG. 13 is an exemplary block diagram showing an equivalent circuit of the pixel P' and its peripheral structure for the writing operation in the electro-optical panel.

FIG. 13 shows an equivalent circuit of the pixel P' shown in FIG. 9 and its peripheral structure for the writing operation. In the drawing, the switch SW1 corresponds to the first transistor TR1 and the switch SW4 corresponds to the sixth transistor TR6.

Figure 14:
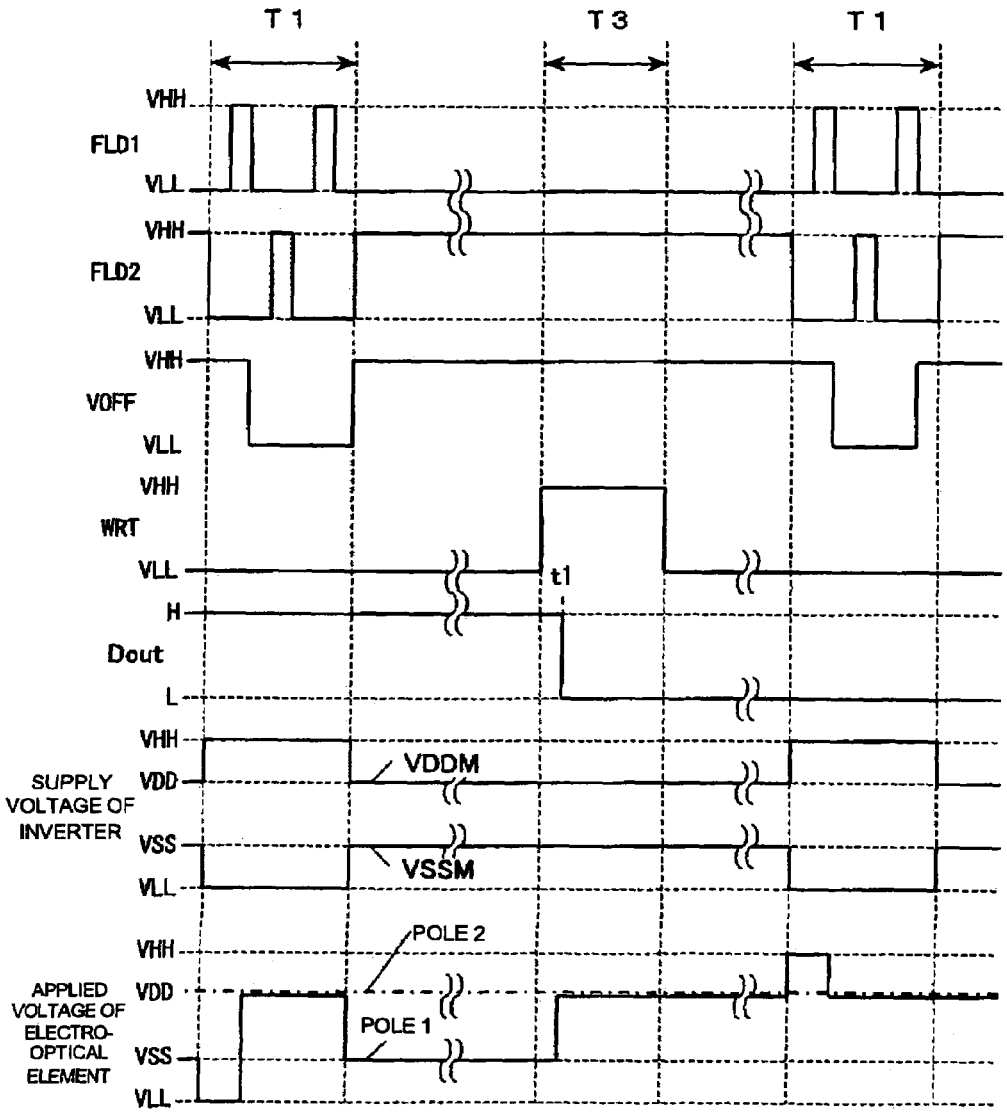
FIG. 14 is a timing chart for the writing operation in the equivalent circuit shown in FIG. 13.

FIG. 14 is a timing chart including the writing operation in the equivalent circuit shown in FIG. 13. In this example, at the writing period T3, the output image data Dout is written to the pixel P'. Since rewriting is performed by the reading operation described above, a voltage applied to the electro-optical element is not reduced due to leak current. Thus, if there is no need to rewrite data, the writing operation is appropriately omitted. Accordingly, the number of times capacitive loads, such as the scanning line 2 and the data line 3, are driven can be reduced, thus reducing power consumption.

At the writing period T3, the scanning signal WRT is at a high level, the control signal VOFF is at a high level, the first field signal FLD1 is at a low level, and the second field signal FLD2 is at a high level. Thus, the switch SW1 is turned on, the switch SW3 is turned off, the switch SW2 is turned on, and the switch SW4 is turned on. Accordingly, a signal flows through the path shown by the thick line in FIG. 13.

When the output image data Dout is changed from the high level to the low level at the time t1 of the writing period T3 shown in FIG. 14, the output logical level of the inverter INV is changed from the low level to the high level, and the OLED element 70, which is an electro-optical element, is changed from the on state to the off state. Thus, the logical level of data stored in the pixel P' is inverted, and turning on and turning off of the electro-optical element can be switched.

A case where the electro-optical device described above is applied to various electronic apparatuses will now be described.

Figure 15:
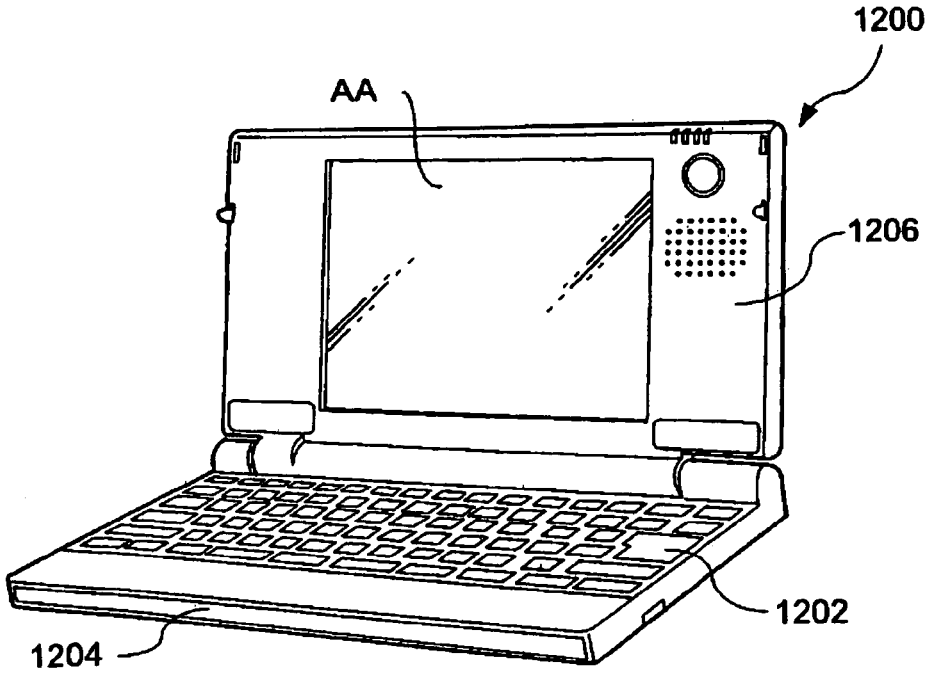
FIG. 15 is a perspective view showing the structure of a personal computer as an example of an electronic apparatus to which the electro-optical device is applied.

An example in which the electro-optical panel AA is applied to a mobile personal computer will first be described. FIG. 15 is a perspective view showing the structure of the personal computer. In the drawing, a computer 1200 includes a main unit 1204 provided with a keyboard 1202. The computer 1200 also includes an electro-optical display unit 1206.

An example in which the electro-optical panel AA is applied to a portable telephone set will then be described.

Figure 16:
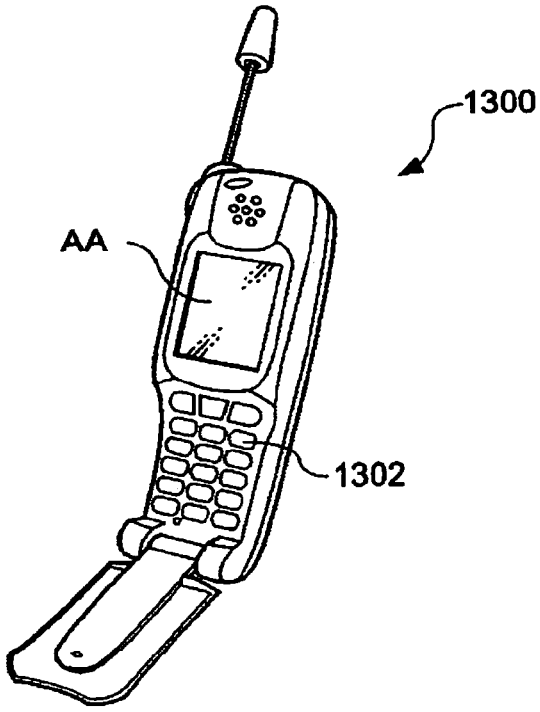
FIG. 16 is a perspective view showing the structure of a portable telephone set as an example of an electronic apparatus to which the electro-optical device is applied.
Figure 17:
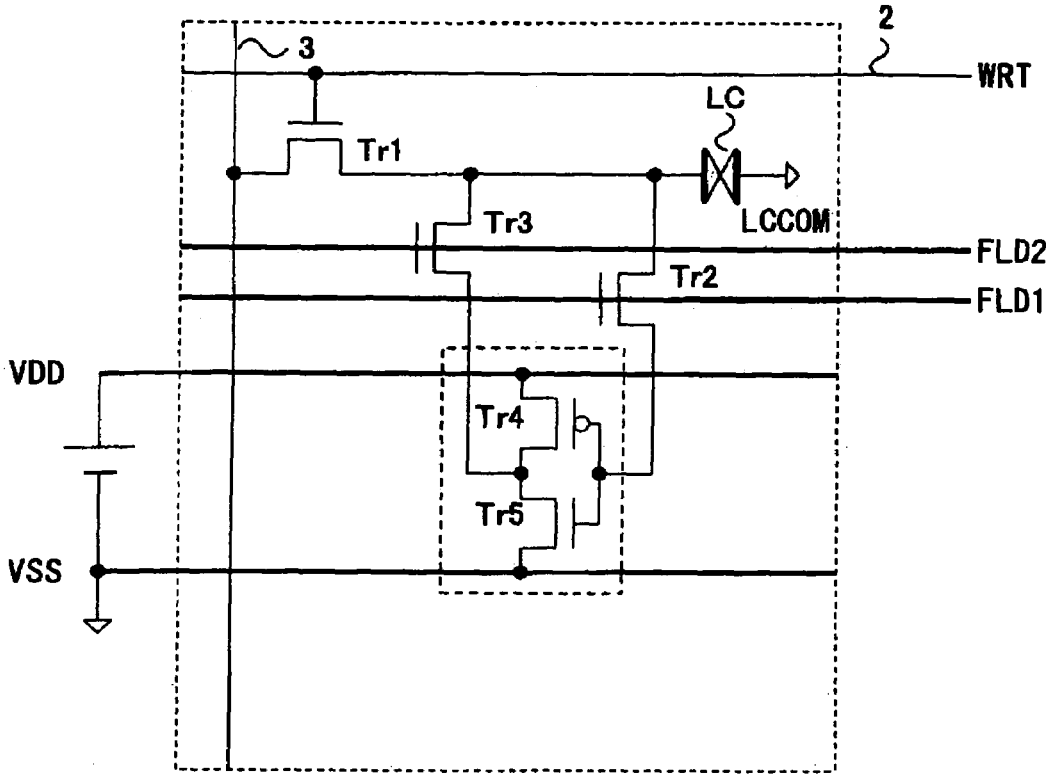
FIG. 17 is an exemplary circuit diagram showing the structure of a known pixel.

FIG. 16 is a perspective view showing the structure of the portable telephone set. In the drawing, a portable telephone set 1300 is provided with a plurality of operation buttons 1302 and the electro-optical panel AA.

It is obvious that, in addition to the electronic apparatuses explained with reference to FIGS. 15 and 16, the electro-optical device described above is applicable to various electronic apparatuses, such as television sets, viewfinder type or monitor direct-view type video tape recorders, car navigation systems, pagers, electronic notebooks, calculators, word processors, work stations, video telephone sets, POS terminals, and apparatuses provided with touch panels.

Thus, while this invention has been described in conjunction with specific embodiments thereof, it is evident that many alternatives, modifications, and variations will be apparent to those skilled in the art. Accordingly, preferred embodiments of the invention as set forth herein are intended to be illustrative, not limiting. Various changes may be made without departing from the spirit and scope of the invention.

What is claimed is:

1. An electro-optical panel, comprising:

a plurality of data lines;

a plurality of scanning lines; and pixels provided in association with intersections of the data lines and the scanning lines, the pixels each including:

a hold capacitor that holds an electric charge;

an inverting device that outputs an output signal obtained by inverting an input signal;

a first switching element provided between the corresponding one of the data lines and the hold capacitor;

a second switching element provided between the hold capacitor and an input of the inverting device;

a third switching element provided between the hold capacitor and an output of the inverting device; and an organic light-emitting diode element coupled to the output of the inverting device.

2. An electro-optical panel, comprising:

a plurality of data lines;

a plurality of scanning lines; and pixels provided in association with intersections of the data lines and the scanning lines, the pixels each including:

an organic light-emitting diode;

a hold capacitor that holds an electric charge;

an inverting device that outputs an output signal obtained by inverting an input signal;

a first switching element provided between the corresponding one of the data lines and the hold capacitor;

a second switching element provided between the hold capacitor and an input of the inverting device;

a third switching element provided between the hold capacitor and an output of the inverting device; and a fourth switching element provided between the output of the inverting device and the organic light-emitting diode.

3. A driving circuit for driving an electro-optical panel, having a plurality of data lines, a plurality of scanning lines, and pixels provided in association with intersections of the data lines and the scanning lines, the pixels each including:

an organic light-emitting diode;

an electric charge holding device that holds an electric charge;

an inverting device that outputs an output signal obtained by inverting an input signal;

a switching device that switches a connection state of the electric charge holding device and the inverting device, output of the inverting device being supplied to the organic light-emitting diode, the driving circuit further comprising:

a control device that controls the switching device such that the electric charge holding device is coupled to an input of the inverting device, and that the electric charge holding device is not coupled to an output of the inverting device at a holding period and that controls the switching device such that the electric charge holding device is coupled to the output of the inverting device an even number of times at a reading period.

4. A driving circuit for driving an electro-optical panel according to claim 3, the electro-optical panel further including first switching elements each provided between each of the data lines and the electric charge holding device, the switching device including a second switching element provided between an output of the electric charge holding device and the input of the inverting device and a third switching element provided between the output of the inverting device and the electric charge holding device, and wherein, in a case where a first state represents a state in which the second switching element is turned off and the third switching element is turned on and a second state represents a state in which the second switching element is turned on and the third switching element is turned off, the control device controls the second switching element and the third switching element to the second state at the holding period and controls the second switching element and the third switching element to perform one cycle operation for changing from the first state to the second state and then changing back to the first state once or more at the reading period.

5. The driving circuit for driving an electro-optical panel according to claim 4, the control device controlling the second switching element and the third switching element such that the transition between the first state and the second state is performed via a third state that represents a state in which the second switching element and the third switching element are turned off.

6. The driving circuit for driving an electro-optical panel according to claim 4, the electro-optical panel further including fourth switching elements each provided between the output of the inverting device and the organic light-emitting diode, and the control device controls the fourth switching elements to an off state during the time at least from the start of the first state to the end of the one cycle operation at the reading period.

7. The driving circuit for driving an electro-optical panel according to claim 3, the inverting device being operated by a high potential source and a low potential source, and the electro-optical panel further including power supply device that supplies a first high potential, as a high potential source, and a first low potential, as a low potential source, to the inverting device at a holding period and that supplies a second high potential that is higher than the first high potential, as the high potential source, and a second low potential that is lower than the first low potential, as the low potential source, to the inverting device at the reading period.

8. The driving circuit for driving an electro-optical panel according to claim 3, the inverting device including a P-channel thin film transistor and an N-channel thin film transistor, and the first to third switching elements being thin film transistors.

9. An electronic apparatus, comprising:

an electro-optical panel including a plurality of data lines, a plurality of scanning lines, and pixels provided in association with intersections of the data lines and the scanning lines, the pixels each including an organic light-emitting diode; and the driving circuit that drives the electro-optical panel as set forth in claim 2.

10. A driving method for driving an electro-optical panel including a plurality of data lines, a plurality of scanning lines, and pixels provided in association with intersections of the data lines and the scanning lines, the pixels each including an organic light-emitting diode, an electric charge holding device that holds an electric charge, an inverting device that outputs an output signal obtained by inverting an input signal, and a switching device that switches a connection state of the electric charge holding device and the inverting device, output of the inverting device being supplied to the organic light-emitting diode, the driving method comprising:

controlling the switching device such that the electric charge holding device is coupled to an input of the inverting device and the electric charge holding device is not coupled to an output of the inverting device at a holding period; and controlling the switching device such that the electric charge holding device is coupled to the output of the inverting device an even number of times at a reading period.

11. The driving method for driving an electro-optical panel according to claim 10, the electro-optical panel further including first switching elements each provided between each of the data lines and the electric charge holding device, the switching device including a second switching element provided between the output of the electric charge holding device and the input of the inverting device and a third switching element provided between the output of the inverting device and the electric charge holding device, the driving method further comprising:

controlling the second switching element and the third switching element to a second state at the holding period; and controlling the second switching element and the third switching element to perform one cycle operation for changing from a first state to the second state and then changing back to the first state once or more at the reading period, the first state representing a state in which the second switching element is turned off and the third switching element is turned on and the second state representing a state in which the second switching element is turned on and the third switching element is turned off.

12. A driving method for driving an electro-optical panel according to claim 11, the driving method further comprising controlling the second switching element and the third switching element such that the transition between the first state and the second state is performed via a third state that represents a state in which the second switching element and the third switching element are turned off.

13. A driving method for driving an electro-optical panel according to claim 11, the electro-optical panel further including fourth switching elements each provided between the output of the inverting device and the organic light-emitting diode, the driving method further comprising controlling the fourth switching elements to be turned off during the time at least from a start of the first state to an end of the one cycle operation at the reading period.

14. A driving method for driving an electro-optical panel according to claim 11, the inverting device being operated by a high potential source and a low potential source, the driving method further, comprising:

supplying a first high potential, as a high potential source, and a first low potential, as a low potential source, to the inverting device at the holding period; and supplying a second high potential that is higher than the first high potential, as the high potential source, and a second low potential that is lower than the first low potential, as the low potential source, to the inverting device at the reading period.

* * * * *